US006148750A

United States Patent [19]

Funato

[11] Patent Number: 6,148,750

[45] Date of Patent: Nov. 21, 2000

[54] SEWING NEEDLE HOLDING UNIT

[75] Inventor: Nobuhiko Funato, Nagoya, Japan

[73] Assignee: Brother Kogyo Kabushiki Kaisha, Aichi-ken, Japan

[21] Appl. No.: 09/298,178

[22] Filed: Apr. 23, 1999

[30] Foreign Application Priority Data

Apr. 27, 1998 [JP] Japan ..... 10-134597

[51] Int. Cl.[7] ..... D05B 55/02

[52] U.S. Cl. ..... 112/226

[58] Field of Search ..... 112/226, 222, 112/227, 80.45; 223/102; 12/80.45

[56] References Cited

U.S. PATENT DOCUMENTS

| | | | |
|---|---|---|---|
| 2,319,829 | 5/1943 | Russell | 112/226 X |
| 2,973,733 | 3/1961 | Johnson | 112/226 |
| 3,581,689 | 6/1971 | Berube | 112/226 |

FOREIGN PATENT DOCUMENTS

| | | | |
|---|---|---|---|
| 570931 | 9/1958 | France | 112/226 |
| 49-90359 | 8/1974 | Japan . | |
| 49-105361 | 9/1974 | Japan . | |
| 59-37980 | 3/1984 | Japan . | |
| 59-37986 | 3/1984 | Japan . | |
| 760204 | 11/1956 | United Kingdom | 112/116 |

*Primary Examiner*—Peter Nerbun
*Attorney, Agent, or Firm*—Oliff & Berridge, PLC

[57] ABSTRACT

The needle head 7*a* of the sewing needle 7 is inserted in the needle insertion hole 12*c* of the needle holding portion 12. The contact element 14 is inserted in the through hole 13*a* formed in the through hole portion 13. The operation screw 15, which is formed from a component separated from the contact element 14, is rotated and screwed into the through hole 13*a*. The operation screw 15 presses against the contact element 14 without rotating the contact element 14, thereby pressingly fixing the sewing needle 7 in place. Therefore, the sewing needle 7 will not tilt or moved downward by rotation of the operation screw 15. In this way, the sewing needle 7 can be simply and accurately positioned.

10 Claims, 7 Drawing Sheets

SEWING NEEDLE HOLDING UNIT

BACKGROUND OF THE INVENTION

1. Field of the Invention

The present invention relates to a sewing needle holding unit for use in a sewing machine, wherein a sewing needle can be attached to the sewing needle holding unit with a high positional precision.

2. Description of the Related Art

There have been provided a variety of types of sewing machines, such as electric household sewing machines and industrial use sewing machines. Normally, sewing machines include a needle bar and a sewing needle holding unit attached to the lower end of the needle bar. A motor drives the needle bar to reciprocally move in the vertical direction. A sewing needle is detachably attached to the sewing needle holding unit. In this way, the sewing needle is also reciprocally moved in the vertical direction.

A loop taker is driven in conjunction with the vertical movement of the needle bar so that stitches can be formed by cooperative operation of the sewing needle and the loop taker.

One type of sewing needle holding unit is formed with a vertical hole in the under surface of its bottom end and a horizontal hole in its side. The horizontal hole extends to the vertical hole. In order to attach a sewing needle to the sewing needle holding unit, first, a head portion of the sewing needle is inserted into the vertical hole from below. The vertical hole is formed slightly larger than the outer periphery of the sewing needle head portion so as to facilitate insertion of the sewing needle. Then, a male screw is screwed into the horizontal hole until the tip of the male screw abuts against the sewing needle head portion. When the male screw is tightly screwed, the sewing needle is pressingly fixed in place within the vertical hole. The male screw is formed from a relatively soft material. This is because if the male screw is formed from a hard material, the male screw can easily break when rotated.

However, when the male screw is screwed into the horizontal hole while rotating, its rotational movement generates a great deal of friction between the tip of the male screw and the sewing needle head portion. Because the vertical hole is formed slightly larger than the outer periphery of the sewing needle head portion as described above, the friction slightly rotates the sewing needle within the vertical hole in the same direction as the rotation of the male screw. As a result, the sewing needle may be fixed in place with a slight tilt. Also, the sewing needle may be slightly lowered by rotation of the screw, resulting in fixing the sewing needle at a position slightly lower than desired.

When the sewing needle is inaccurately attached in this manner, an eye of the sewing needle is shifted from the accurate position. As a result, the loop taker beak of the loop taker may not accurately catch the upper thread loop extending from the eye of the sewing needle. This causes skipped stitches. Also, the sewing needle may be damaged by bumping against the loop taker.

Further, because the male screw is formed from the relatively soft material, the tip of the male screw easily deforms by pressing against the sewing needle. The deformed tip enters and catches onto the sewing needle. As a result, when the male screw is tightened, the sewing needle is further easily rotated. This results in fixing the sewing needle in place at an undesired position or orientation.

Japanese Utility Model Application Publication No. SHO-49-90359 discloses a different type of sewing needle holding unit. Specifically, the sewing needle holding unit includes a clasp supported within a lower end portion of the needle bar. Both the lower end portion of the needle bar and the clasp have a slightly V-shaped cross section. The clasp is formed with a screw hole. With this configuration, a sewing needle is first inserted into a predetermined space defined between the needle bar and the clasp. Then, a male screw is screwed into the screw hole. As a result, the clasp moves relative to the needle bar, so the sewing needle is pressed between the needle bar and the clasp. In this way, the sewing needle is pressingly fixed in place.

However, producing the needle bar with the V-shaped end portion requires precise metal work, resulting in complicating overall manufacture processes of the sewing machine. Also, manufacturing costs are increased because the clasp has a complicated shape and a relatively large size.

Japanese Utility Model Application Publication No. SHO-49-105361 discloses another type of sewing needle holding unit. Specifically, the sewing needle holding unit includes a needle mount and a judgement plate both supported by a lower portion of the needle bar. A sewing needle is first inserted into a predetermined space defined between the needle mount and the needle bar. By screwing a male screw into a hole formed in the needle mount, the needle mount moves relative to the needle bar. As a result, the sewing needle is pressingly fixed in place between the needle mount and the needle bar.

However, this configuration requires the needle mount of a relatively large size and a complicated shape, thereby increasing its manufacturing cost.

Japanese Patent Application-Publication No. SHO-59-37986 discloses another type of sewing needle holding unit. The sewing needle holding unit includes a needle mount. The needle mount is supported at a lower portion of the needle bar such that a space is formed between the needle mount and the needle bar. A spacer is slidably and pivotably supported within the space by a screw. A sewing needle is inserted between the spacer and the needle bar. When a male screw is screwed into a screw hole formed to the needle mount, the spacer is pushed toward the sewing needle. By tightly screwing the male screw, the sewing needle is fixed in place between the spacer and the needle bar.

However, complicated operations are required for attaching the spacer between the needle mount and the needle bar. Also, the needle bar needs to be processed so that the needle bar can support the spacer and the sewing needle. Further, the configuration of the sewing needle supporting unit is complicated.

SUMMARY OF THE INVENTION

It is an objective of the present invention to provide a sewing needle holding unit capable of simply and accurately attaching a sewing needle at a proper position using a simple, inexpensive, and compact configuration.

In order to achieve the above and other objectives, there is provided a sewing needle holding unit attached to a needle bar of a sewing machine. The sewing needle holding unit includes a body attached to a lower end of the needle bar, a contact member, and a placing member. The body is formed with a first hole and a second hole. A sewing needle is inserted in the first hole. The first hole extends in a first direction and defines a peripheral surface. The second hole extends in a second direction intersecting the first direction, connects with the first hole, and defines a female screw portion. The contact member is inserted in the second hole. The placing member has a male screw portion for threadingly engaging the female screw portion to place the contact member at a predetermined position within the second hole. The contact member and the placing member are formed from separate components. When the contact member is positioned at the predetermined position, the sewing needle inserted in the first hole of the body is fixed in place by being in tight abutment with the peripheral surface of the first hole and the contact member.

BRIEF DESCRIPTION OF THE DRAWINGS

The particular features and advantages of the invention as well as other objects will become more apparent from the following description taken in connection with the accompanying drawings, in which.

DETAILED DESCRIPTION OF THE PREFERRED EMBODIMENT

A sewing needle holding unit 10 according to a preferred embodiment of the present invention will be described while ref erring to the accompanying drawings. In 20 the following description, the expressions "right", "left", "front", "rear", "upper", "lower", and "vertical" are used throughout the description to define the various parts when the sewing machine is disposed in an orientation in which it is intended to be used.

Figure 1:
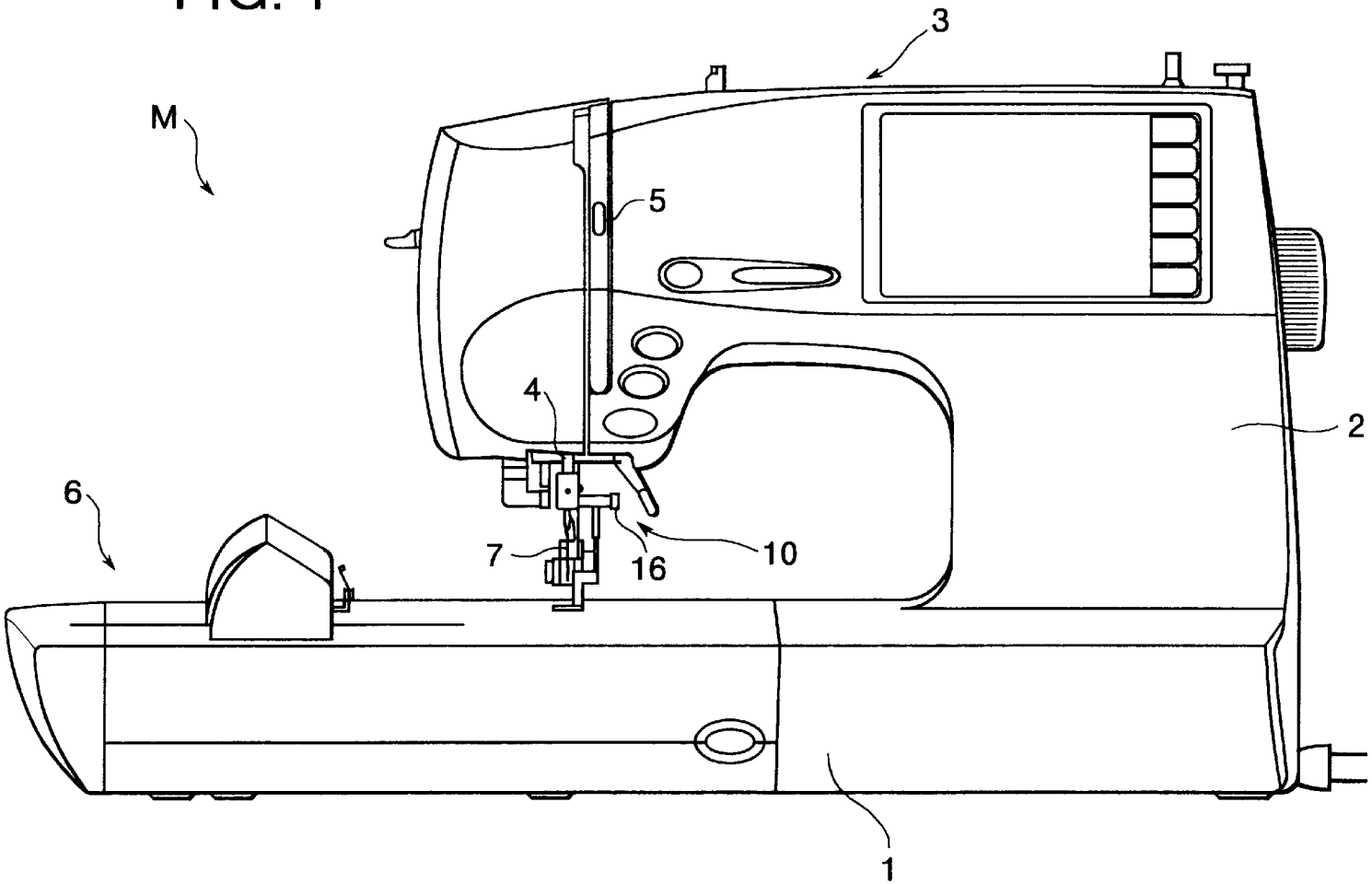
FIG. 1 is a side view of a sewing machine wherein a sewing needle holding unit according to an embodiment of the present invention is used.

First, a general configuration of a sewing machine M which includes the sewing needle holing unit 10 will be described while referring to FIG. 1. The sewing machine M is an electric sewing machine and includes a bed portion 1, a column portion 2, an arm portion 3, and an embroidery frame drive mechanism 6. The column portion 2 extends upright from the left end of the bed portion 1. The arm portion 3 extends over the bed portion 1 leftward from the upper end of the column portion 2. The arm portion 3 is provided with a needle bar 4, a thread takeup lever 5, a sewing needle 7 having a needle head 7*a,* and the needle holding unit 10. The needle holding unit 10 is mounted on the lower end of the needle bar 4 and supports the sewing needle 7 at the needle head 7*a*. The sewing machine M is further provided with a free bed portion (not shown) at the left end of the bed portion 1. The embroidery frame drive mechanism 6 is detachably mounted on the free bed portion.

Although not shown in the drawings, the bed portion 1 includes a feed dog vertical movement mechanism for moving a feed dog in the vertical direction, a feed dog front/rear movement mechanism for moving the feed dog in the front and rear directions, and a loop taker, such as a vertical axis oscillating shuttle, for housing a lower thread bobbin. The loop taker operates in cooperation with the sewing needle 7 to make stitches.

Also, the arm portion 3 further includes a needle bar vertical movement mechanism, a needle bar swing movement mechanism, and a thread takeup lever vertical movement mechanism. The needle bar vertical movement mechanism is for vertically moving the needle bar 4. The needle bar swing movement mechanism is for swinging the needle bar 4 in the right and left directions, which are perpendicular to a feed direction of a work piece cloth. The thread takeup lever vertical movement mechanism is for vertically moving the thread takeup lever 5 in synchronization with vertical movement of the needle bar 4.

Further, the embroidery frame drive mechanism 6 includes a Y direction drive mechanism for moving a embroidery frame in a Y direction i.e., front and rear directions, and an X direction drive mechanism for moving the embroidery frame in an X direction i.e., left and right directions.

Figure 2:
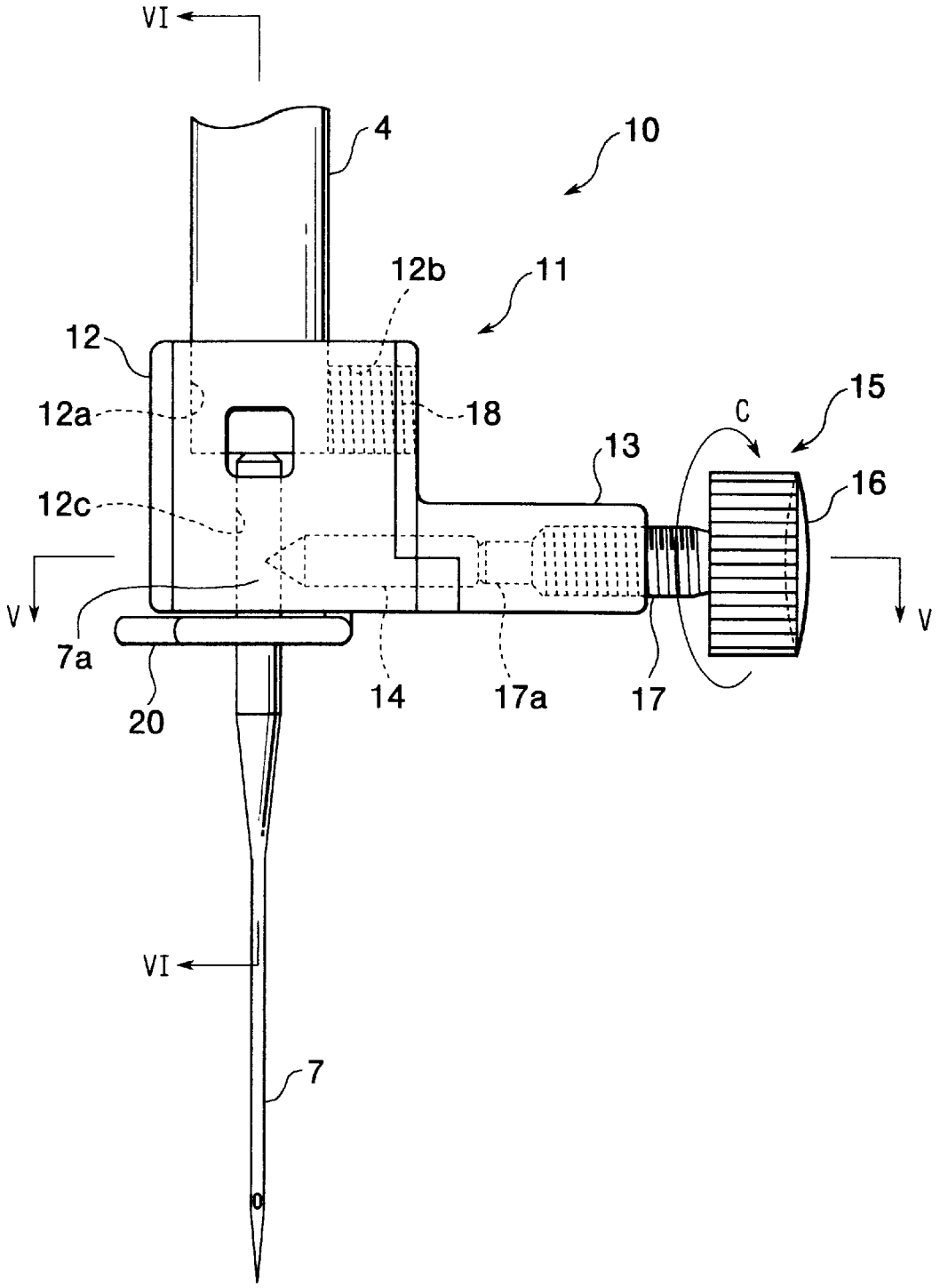
FIG. 2 is a magnified front view showing components surrounding the sewing needle holding unit according to the embodiment.
Figure 3:
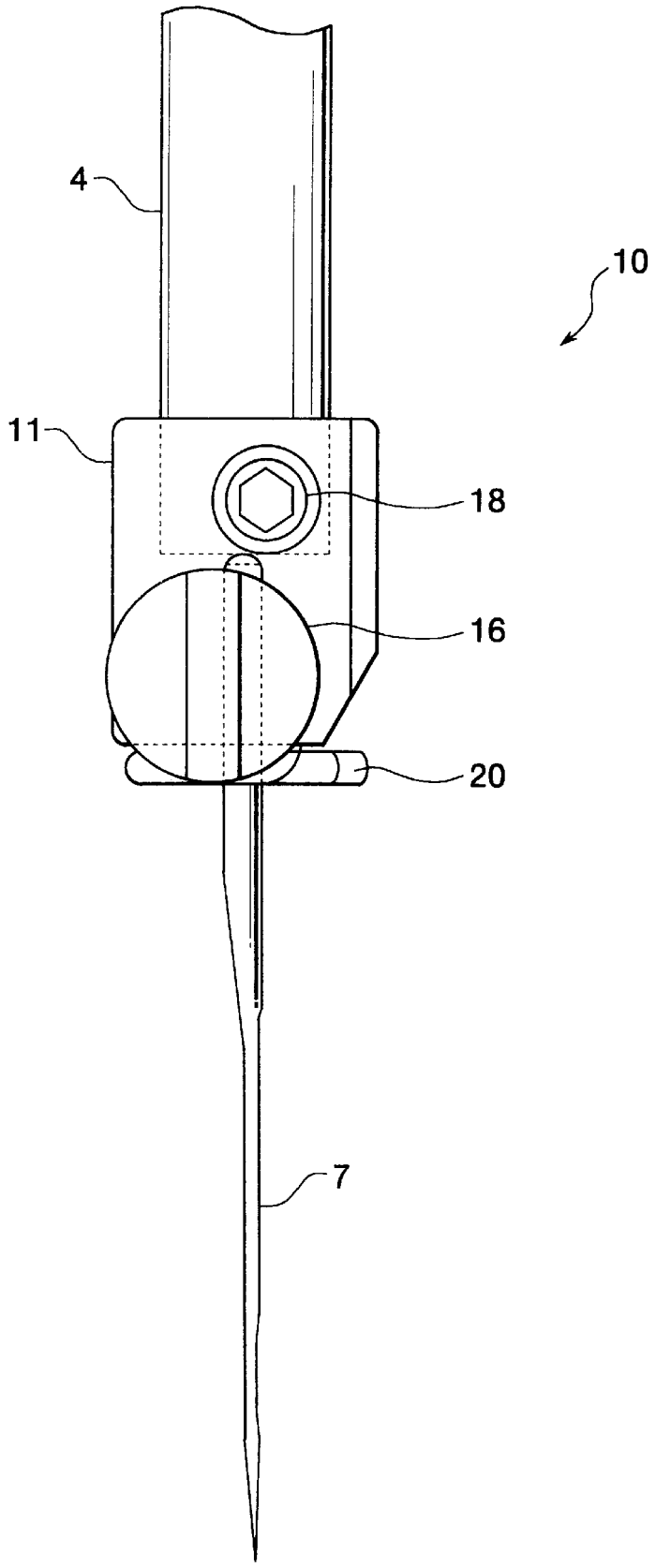
FIG. 3 is a side view showing the sewing needle holding unit of FIG. 2.

Next, the needle holding unit 10 will be described while referring to FIGS. 2 to 6. As shown in FIGS. 2 and 3, the needle holding unit 10 is mounted on the lower end of the needle bar 4 and supports the sewing needle 7. The needle holding unit 10 includes a needle mount 11, a pin-shaped contact element 14, an operation screw 15, and a fixing screw 18. A wire shaped thread guide 20 for guiding an upper thread (not shown) is attached to the lower end of the needle mount 11.

The needle mount 11 includes a vertically extending needle holding portion 12 and a horizontally extending through hole portion 13. The needle holding portion 12 is formed with a needle bar hole 12*a,* a screw hole 12*b,* and a needle insertion hole 12*c*. The needle bar hole 12*a* is formed vertically into the upper half of the needle holding portion 12. The needle bar 4 is inserted in the needle bar hole 12*a*. The screw hole 12*b* is formed horizontally into the upper half of the needle holding portion 12. The fixing screw 18 is screwed into the screw hole 12*b*.

Figure 4:
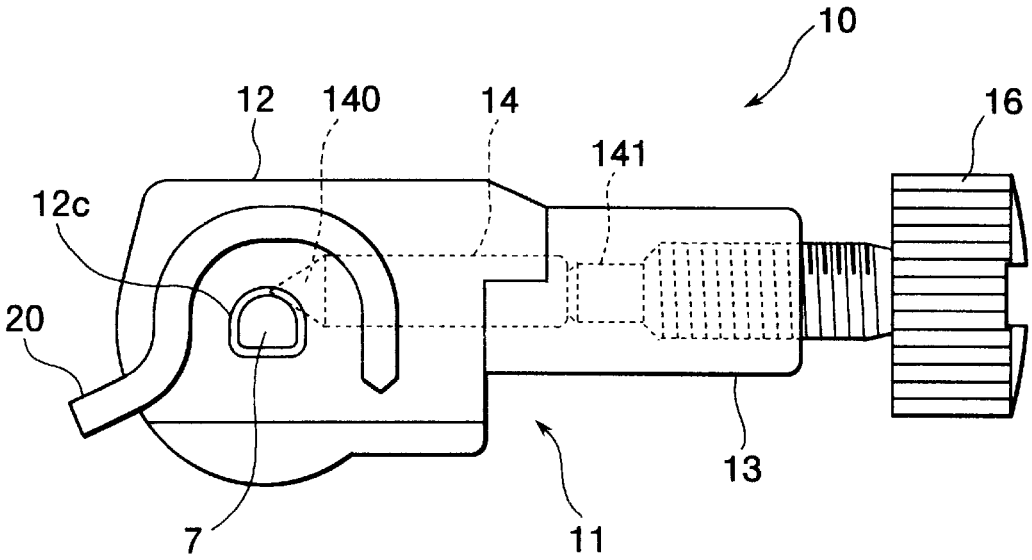
FIG. 4 is a bottom view showing the sewing needle holding unit of FIG. 2.
Figure 5:
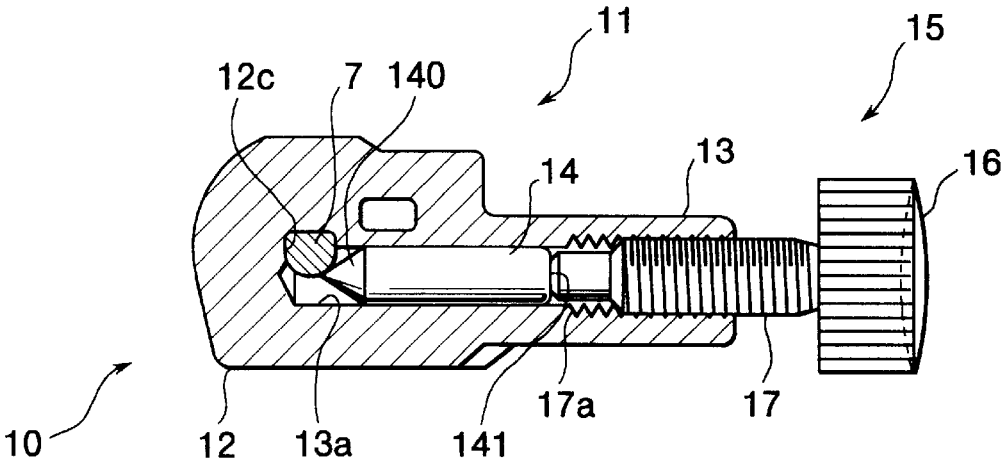
FIG. 5 is a cross-sectional view taken along a line V—V of FIG. 2.
Figure 6:
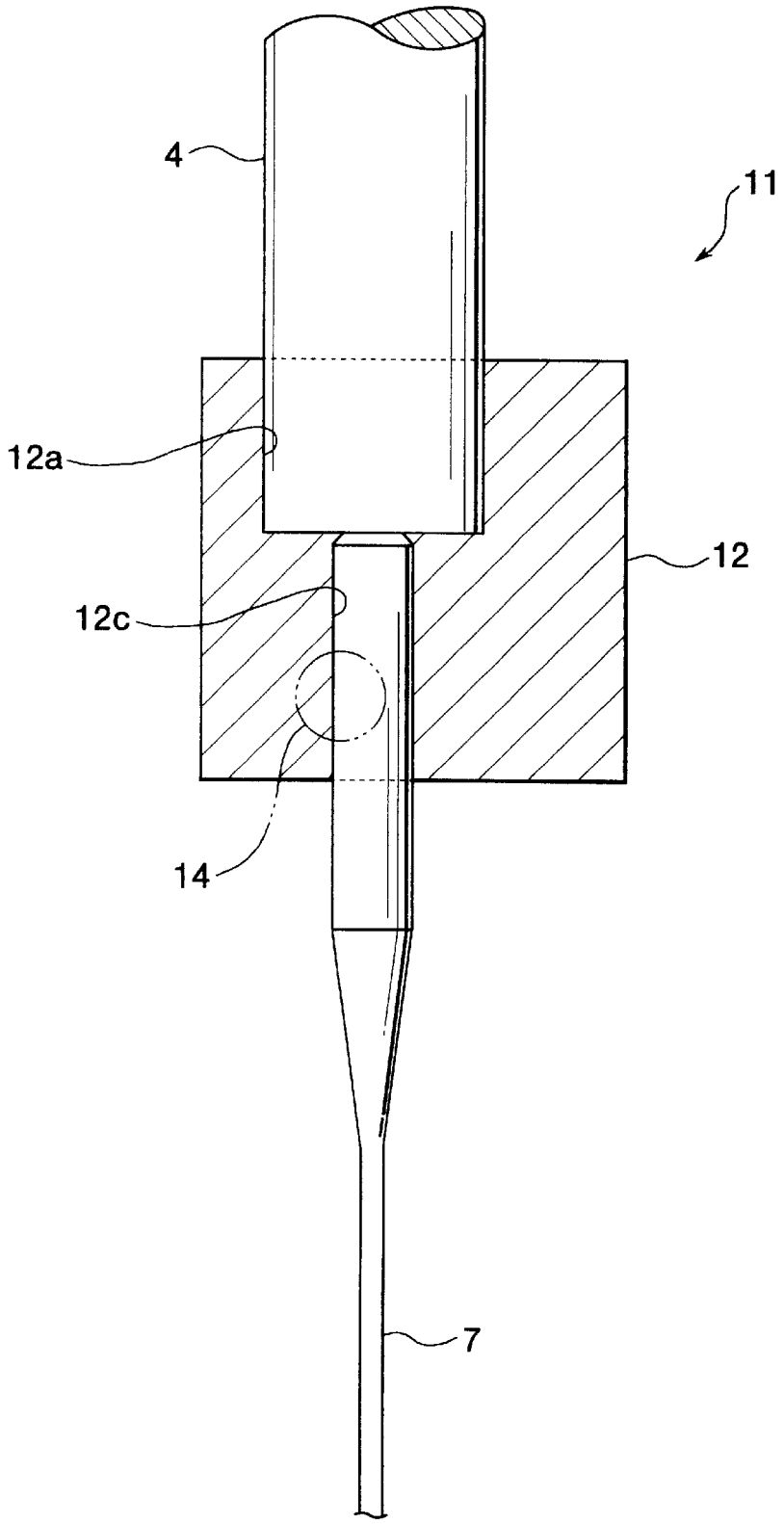
FIG. 6 is a cross-sectional view taken along a line VI—VI of FIG. 2.

The needle insertion hole 12*c* is formed vertically into the lower half of the needle holding portion 12, and connects with the needle bar hole 12*a*. The sewing needle 7 is inserted into the needle insertion hole 12*c*. It should be noted that, as shown in FIGS. 4 and 5, the needle insertion hole 12*c* is formed in the same semi-circular shape in cross section as the needle head 7*a* of the sewing needle 7.

The through hole portion 13 is formed integrally with the needle holding portion 12 so as to extend rightward as viewed in FIG. 2 from the lower end of the needle holding portion 12. The through hole portion 13 is formed with a cylindrical through hole 13*a*. As shown in FIG. 5, the through hole 13*a* extends horizontally into communication with the needle insertion hole 12*c*. The through hole 13*a* includes a female screw portion of a predetermined length, from an outer open end to about a center of the through hole portion 13.

The contact element 14 has substantially the same outer shape as the inner periphery of the through hole 13*a* and a diameter substantially equal to an inner diameter of the through hole 13*a*. The contact element 14 is formed with a conical end 140 and a flat end 141 at opposite ends thereof. As shown in FIG. 5, when the contact element 14 is inserted in the through hole 13*a,* the conical end 140 contacts the sewing needle 7 at its slanting surface rather than its point.

The operation screw 15 includes a grip member 16, a male screw portion 17, and a straight portion 17*a,* all formed integrally with one another. The male screw portion 17 is formed so as to threadingly engage the female screw portion of the through hole 13*a*. In this embodiment, when the operation screw 15 is rotated in the clockwise direction indicated by an arrow C in FIG. 2, the operation screw 15 is tightened. On the other hand, when the operation screw 15 is rotated in the counterclockwise direction, the operation screw 15 is loosened.

The contact element 14 is formed from high carbon steel, carbide, or a ceramic material. On the other hand, the operation screw 15 is formed from a normal steel that is easily processed into the operation screw 15. In other words, the contact element 14 has a greater hardness than the operation screw 15.

Next, an operation for attaching the needle holding unit 10 to the needle bar 4 will be described. First, the lower end of the needle bar 4 is inserted in the needle bar hole 12*a* of the needle mount 11. Then, the fixing screw 18 is inserted and screwed into the screw hole 12*b*. As a result, the needle bar 4 is fixed in place within the needle bar hole 12*a* by the fixing screw 18. In this way, the needle mount 11 is mounted on the lower end of the needle bar 4.

Next, operations for attaching the sewing needle 7 to the needle mount 11 will be described. First, the needle head 7*a* of the sewing needle 7 is inserted into the needle insertion hole 12*c* from below. Next, the contact element 14 is inserted into the through hole 13*a* so that the conical end 140 faces the sewing needle 7. Then, the operation screw 15 is also inserted into the through hole 13*a*. The operation screw 15 is rotated in the clockwise direction C by a user rotating the grip member 16. The operation screw 15 is screwed into the through hole 13*a,* and pushes the contact element 14 toward the sewing needle 7. At this time, because the contact element 14 and the operation screw 15 are separate components, the contact element 14 will not rotate in synchronization with the operation screw 15, but will merely move in a direction for pressing against the sewing needle 7. As the operation screw 15 is further screwed into the through hole 13*a,* the contact element 14 is positioned in place where the contact element 14 is in tight abutment with the sewing needle 7 and the operation screw 15. As a result, the sewing needle 7 is tightly pressed between a wall defining the needle insertion hole 12*c* and the contact element 14. In this way, the sewing needle 7 is pressingly fixed in the needle insertion hole 12*c*.

As described above, according to the present embodiment, the contact element 14 does not rotate at the attaching operation. Therefore, the sewing needle 7 can be strongly and reliably attached in place in a simple manner without the sewing needle 7 tilting or moving downwards.

Also, because the contact element 14 contacts the sewing needle 7 at the conical end 140, the sewing needle 7 can be effectively fixed in place.

Because the contact element 14 and the straight portion 17*a* of the operation screw 15 contact each other along plain surfaces, the operation screw 15 can effectively press the contact element 14. Also, both the contact element 14 and the operation screw 15 have increased durability against pressure generated therebetween.

Further, the operation screw 15 is formed from an integral grip member 16, the male screw portion 17, and the straight portion 17*a*. Therefore, the total number of components can be decreased and operations for assembling the needle holding unit 10 can be simplified.

Further, because only the contact element 14 and the operation screw 15 are provided in the through hole 13*a,* the needle holding unit 10 has a simple configuration.

Moreover, because the contact element 14 is formed from a material with a great hardness, the contact element 14 does not easily deform under pressure contact with the sewing needle 7. As a result, shifting of the sewing needle 7 out of its desired attachment position due to deformation of the needle 7 can be further reliably prevented. Also, because the operation screw 15 is formed from a material with a small hardness, the operation screw 15 can be prevented from breaking when rotated.

Next, a needle mount 11A according to a modification of the embodiment will be described while referring to FIG. 7. It should be noted that, as described above, the contact element 14 is prevented from rotating during the operation for attaching the sewing needle 7, that is, when the contact element 14 approaches the sewing needle 7. However, it does not matter whether the contact element 14 rotates when the contact element 14 is separated away from the sewing needle 7.

Figure 7:
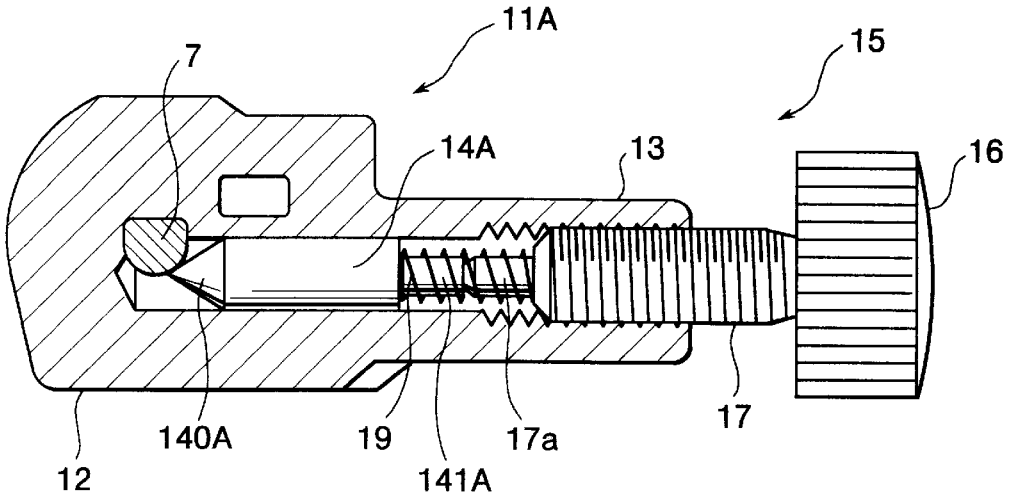
FIG. 7 is a cross-sectional view showing a modification of the present embodiment.

As shown in FIG. 7, the needle mount 11A has a similar configuration as the above-described needle mount 11. However, the needle mount 11A includes a contact element 14A and a right hand wound coil spring 19. The contact element 14A is formed with a protrusion 141A. One end of the coil spring 19 is attached to the protrusion 141A so that the coil spring 19 rotates integrally with the contact element 141A. The other end of the coil spring 19 is mounted on, but unattached to, the straight portion 17*a*. The coil spring 19 has a diameter slightly greater than either the protrusion 141A and the straight portion 17*a* when burdened with no rotational load.

With this configuration, when the operation screw 15 is screwed into the through hole 13*a,* that is, rotated in the clockwise direction C in this example, the rotation of the straight portion 17*a* will not affect the coil spring 19. Therefore, the contact element 14A and the coil spring 19 will be pressed toward the sewing needle 7 without rotating integrally with the operation screw 15.

However, when the operation screw 15 is rotated in the counterclockwise direction, friction generated between the coil spring 19 and the straight portion 17*a* contracts the radius of the coil spring 19, which pinches down on the straight portion 17*a* accordingly. The contact element 14A and the coil spring 19 rotate in association with the operation screw 15 and pull away from the sewing needle 7 as the operation screw 15 is drawn out.

In this way, the contact element 14A will be retracted away from the needle insertion hole 12*c* during replacement of the sewing needle 7. Therefore, the new sewing needle 7 can be properly and easily inserted into the needle insertion hole 12*c* by the desired predetermined depth without interference with the contact element 14A.

While the invention has been described in detail with reference to specific embodiments thereof, it would be apparent to those skilled in the art that various changes and modifications may be made therein without departing from the spirit of the invention, the scope of which is defined by the attached claims.

For example, in the embodiment described above, the contact element 14 and the operation screw 15 are formed from different materials with different harnesses. However, the contact element 14 and the operation screw 15 can be from the same material. In this case, the contact element 14 should be hardened by heat treatment to hardness harder than the operation screw 15. It should be noted that the end of the conventional male screw can be hardened in order to prevent deformation at the end. Alternatively, a hard material can be molded or fused onto the end of the conventional male screw.

Figure 8:
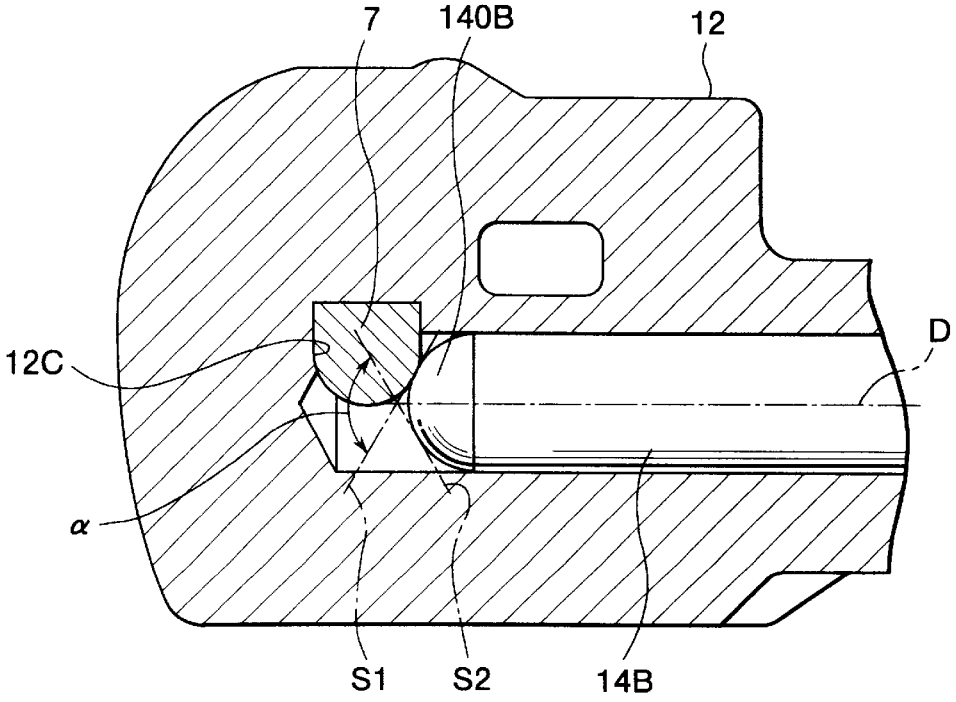
FIG. 8 is a cross-sectional view showing another modification of the embodiment.
Figure 9:
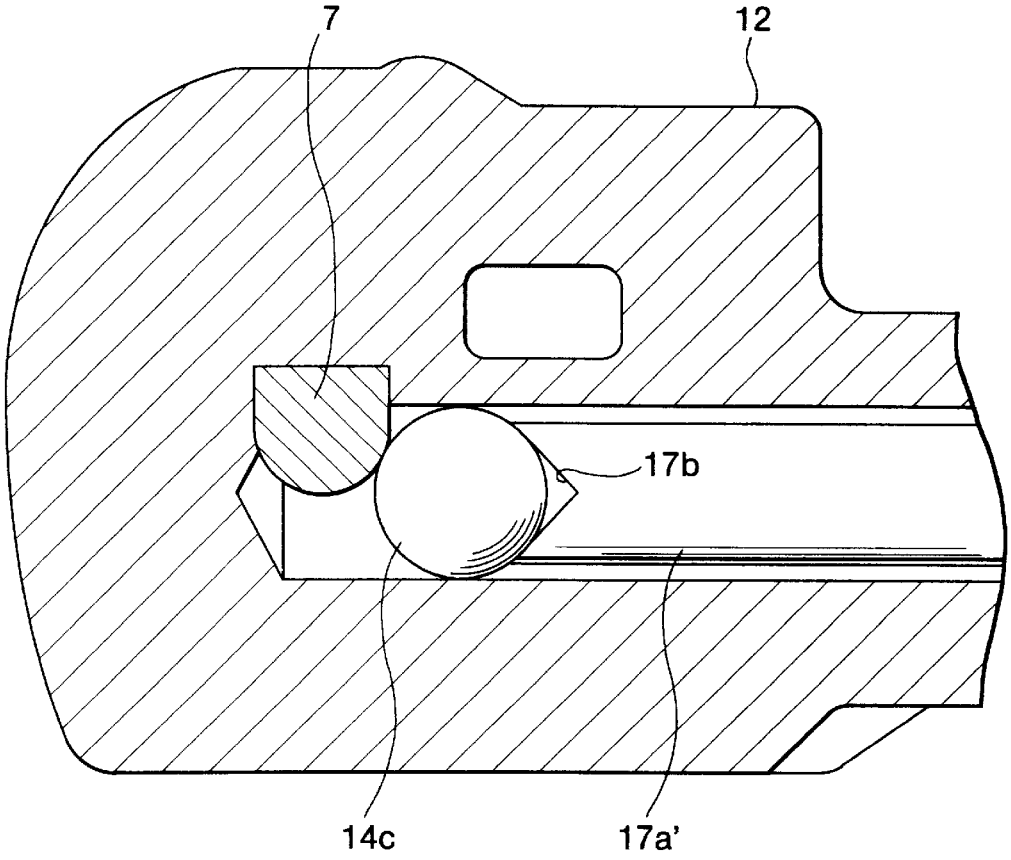
FIG. 9 is a cross-sectional view showing another modification of the embodiment.

Also, as shown in FIG. 8, a contact element 14B having a semi-circular end 104B with a curved surface can be used rather than the above-described contact element 14. Alternatively, as shown in FIG. 9, a ball-shaped contact element 14C can be used instead of the pin-shaped contact element 14. In this case, a straight portion 17*a'* can be formed with a cutout portion 17*b* for engaging the ball-shaped contact element 14C.

In any case, it is desirable that the ends of the contact elements contact the sewing needle 7 at a desirable angle. A detail description will be provided while referring to FIG. 8 as a representative example, wherein the contact element 140B contacts the sewing needle 7 at an angle $\alpha$ of 50 degrees or greater between a tangent line S1, where the contact element 14 contacts the sewing needle 7, and a symmetrical line S2, which is symmetric with the pungent line S1 with respect to a progression direction C of the contact element 14B. When the angle $\alpha$ is less than 50 degrees, there is a danger that an excessive amount of pressure can operate on the sewing needle 7 when the operation screw 15 is tightened, thereby damaging the wall surfaces of the needle insertion hole 12*c*.

Also, although in the above-described embodiment the grip member 16 and the male screw portion 17 are formed integrally, a grip member and a pin-shaped male screw portion can be formed from separate components. In this case, the male screw portion is formed to the grip member rather than to the male screw portion. The sewing needle 7 can be fixed by inserting both the contact element 14 and the male screw portion into the through hole 13*a* and then by screwing the grip member.

Also, the contact element 14 can be formed with a rectangular shape when viewed in cross-section horizontally through its lengthwise axis.

The present invention can be applied to a needle holding unit used in a variety of different types of sewing machines, such as, domestic or industrial sewing machines.

In the above-described embodiments, the needle insertion hole extends in the vertical direction, and the through hole extends in the horizontal direction that is perpendicular to the vertical direction. However, the needle hole can be formed to extend in any direction intersecting the direction in which the needle insertion hole extends.

What is claimed is:

1. A sewing needle holding unit attached to a needle bar of a sewing machine, comprising:

a body that is attached to a lower end of the needle bar, the body being formed with a first hole and a second hole, wherein a sewing needle is inserted in the first hole, the first hole extends in a first direction and defines a peripheral surface, the second hole extends in a second direction intersecting the first direction and connects with the first hole, the second hole defines a female screw portion and has substantially a constant diameter in cross-section;

a contact member that is inserted in the second hole; and a placing member having a male screw portion for threadingly engaging the female screw portion to move the contract member toward the first hole in which the sewing needle is inserted, the placing member and the contact member having substantially the same diameter in cross-section so that the movement of the placing member toward the first hole is not restricted, wherein the contact member and the placing member are formed from separate components, and holding force for holding the sewing needle by the peripheral surface of the first hole and the contact member can be increasingly varied as the placing member is inserted in the second hole in a deeper level.

2. The sewing needle holding unit according to claim 1, further comprising an operation member that is operated by a user to move the placing member to place the contact member at the predetermined position.

3. The sewing needle holding unit according to claim 2, wherein the placing member is formed integrally with the operation member.

4. The sewing needle holding unit according to claim 1, wherein the contact member has a flat end, and the placing member has a flat end, and wherein when the placing member places the contact member at the predetermined position, the flat end of the contact member is in facial contact with the flat end of the placing member.

5. The sewing needle holding unit according to claim 1, wherein the contact member has a diameter substantially equal to an inner diameter of the second hole.

6. The sewing needle holding unit according to claim 1, wherein the contact member has a pin shape with a conical end.

7. The sewing needle holding unit according to claim 1, wherein the contact member contacts the sewing needle at an angle of 50 degrees or greater between a tangent line, where the contact member contacts the sewing needle, and a symmetrical line, which is symmetric with a tangent line with respect to a progression direction of the contact member.

8. A sewing needle holding unit attached to a needle bar of a sewing machine, comprising:

a body that is attached to a lower end of the needle bar, the body being formed with a first hole and a second hole, wherein a sewing needle is inserted in the first hole, the first hole extends in a first direction and defines a peripheral surface, the second hole extends in a second direction intersecting the first direction and connects with the first hole, and the second hole defines a female screw portion;

a contact member that is inserted in the second hole; and a placing member having a male screw portion for threadingly engaging the female screw portion to place the contact member at a predetermined position within the second hole, wherein the contact member and the placing member are formed from separate components, and when the contact member is positioned at the predetermined position, the sewing needle inserted in the first hole of the body is fixed in place by being in tight abutment with the peripheral surface of the first hole and the contact member, said sewing needle holding unit further comprising a coil spring having one end and another end opposite from the one end, wherein the contact member is formed with a protrusion, the one end of the coil spring is attached to the protrusion, the another end of the coil spring is mounted on the placing member without being attached to the placing member, and where when the placing member is rotated in a first rotational direction to be screwed into the second hole, the contact member and the coil spring are pressed toward the sewing needle without rotating integrally with the placing member, and when the placing member is rotated in a second direction opposite from the first rotational direction, the contact member and the coil spring rotate in association with the placing member and are pulled away from the sewing needle as the placing member is drawn out from the second hole.

9. A sewing needle holding unit attached to a needle bar of a sewing machine, comprising:

a body that is attached to a lower end of the needle bar, the body being formed with a first hole and a second hole, wherein a sewing needle is inserted in the first hole, the first hole extends in a first direction and defines a peripheral surface, the second hole extends in a second direction intersecting the first direction and connects with the first hole, and the second hole defines a female screw portion;

a contact member that is inserted in the second hole; and a placing member having a male screw portion for threadingly engaging the female screw portion to place the contact member at a predetermined position within the second hole, wherein the contact member and the placing member are formed from separate components, and when the contact member is positioned at the predetermined position, the sewing needle inserted in the first hole of the body is fixed in place by being in tight abutment with the peripheral surface of the first hole and the contact member, the contact member has a ball shape, and the placing member is formed with a cutout portion for engaging the contact member.

10. A sewing needle holding unit attached to a needle bar of a sewing machine, comprising:

a body that is attached to a lower end of the needle bar, the body being formed with a first hole and a second hole, wherein a sewing needle is inserted in the first hole, the first hole extends in a first direction and defines a peripheral surface, the second hole extends in a second direction intersecting the first direction and connects with the first hole, and the second hole defines a female screw portion;

a contact member that is inserted in the second hole; and a placing member having a male screw portion for threadingly engaging the female screw portion to place the contact member at a predetermined position within the second hole, wherein the contact member and the placing member are formed from separate components, and when the contact member is positioned at the predetermined position, the sewing needle inserted in the first hole of the body is fixed in place by being in tight abutment with the peripheral surface of the first hole and the contact member, and the contact member has a hardness greater than a hardness of the placing member.

* * * * *